US008100668B2

(12) United States Patent
Yoo et al.

(10) Patent No.: US 8,100,668 B2
(45) Date of Patent: Jan. 24, 2012

(54) APPARATUS AND METHOD FOR CONTROLLING OPERATION OF A LINEAR COMPRESSOR USING A DETECTED INFLECTION POINT

(75) Inventors: Jae-Yoo Yoo, Gyeonggi-Do (KR); Ji-Won Sung, Seoul (KR); Chel-Woong Lee, Seoul (KR)

(73) Assignee: LG Electronics Inc., Seoul (KR)

( * ) Notice: Subject to any disclaimer, the term of this patent is extended or adjusted under 35 U.S.C. 154(b) by 862 days.

(21) Appl. No.: 12/087,343

(22) PCT Filed: Dec. 28, 2006

(86) PCT No.: PCT/KR2006/005842

§ 371 (c)(1),
(2), (4) Date: Jul. 2, 2008

(87) PCT Pub. No.: WO2007/078115

PCT Pub. Date: Jul. 12, 2007

(65) Prior Publication Data

US 2009/0004026 A1 Jan. 1, 2009

(30) Foreign Application Priority Data

Jan. 3, 2006 (KR) ..... 10-2006-0000677

(51) Int. Cl.
*F04B 49/06* (2006.01)
*H02P 1/00* (2006.01)

(52) U.S. Cl. ..... 417/44.11; 318/135; 417/53

(58) Field of Classification Search ..... 417/44.11, 417/44.1, 53, 212, 45, 417; 318/632, 135
See application file for complete search history.

(56) References Cited

U.S. PATENT DOCUMENTS

| | | | | |
|---|---|---|---|---|
| 6,682,310 | B2 * | 1/2004 | Yoo et al. | 417/42 |
| 6,685,438 | B2 * | 2/2004 | Yoo et al. | 417/44.11 |
| 6,753,665 | B2 * | 6/2004 | Ueda et al. | 318/135 |
| 6,851,934 | B2 | 2/2005 | Yoo et al. | |
| 7,459,868 | B2 * | 12/2008 | Yoo et al. | 318/119 |
| 2002/0064464 | A1 | 5/2002 | Hwang et al. | |
| 2003/0026701 | A1 | 2/2003 | Yoo et al. | |
| 2003/0026702 | A1 * | 2/2003 | Yoo et al. | 417/44.11 |
| 2006/0251523 | A1 * | 11/2006 | Lee et al. | 417/44.1 |

FOREIGN PATENT DOCUMENTS

| | | |
|---|---|---|
| CN | 1346937 | 5/2002 |
| CN | 1400388 | 3/2003 |
| JP | 09-126147 | 5/1997 |
| JP | 2002-188560 | 7/2002 |

* cited by examiner

*Primary Examiner* — Devon C Kramer
*Assistant Examiner* — Nathan Zollinger
(74) *Attorney, Agent, or Firm* — McKenna Long & Aldridge LLP

(57) ABSTRACT

An apparatus and method for controlling an operation of a reciprocating compressor are disclosed in which a point of inflection with respect to an operation frequency of the reciprocating compressor is detected at a point of time when a phase difference between current and stroke is uniformly maintained, and an operation of the reciprocating compressor is controlled upon recognizing the detected point of inflection with respect to the operation frequency as a point TDC=O. The apparatus for controlling an operation of a reciprocating compressor includes: a control unit for detecting a phase difference between current and stroke and outputting a frequency inflection point detect signal or a frequency variable signal; and a stroke reference value control unit for determining whether a frequency inflection point has been detected or not according to the frequency inflection point detect signal and outputting a stroke reference value control signal based on the determining result.

20 Claims, 4 Drawing Sheets

APPARATUS AND METHOD FOR CONTROLLING OPERATION OF A LINEAR COMPRESSOR USING A DETECTED INFLECTION POINT

This application claims the benefit of PCT/KR2006/005842 filed 28 Dec. 2006, which claims the benefit of Korean Application No. 10-2006-0000677 filed 3 Jan. 2006, which are hereby incorporated by reference for all purposes as if fully set forth herein.

BACKGROUND OF THE INVENTION

1. Field of the Invention

The present invention relates to a compressor and, more particularly, to an apparatus and method for controlling an operation of a reciprocating compressor which are capable of reducing power consumption of a reciprocating compressor and improving reliability of linear controlling.

2. Description of the Related Art

In general, a reciprocating compressor is operated to suck, compress and discharge a refrigerant gas by reciprocally and linearly moving a piston in a cylinder provided therein.

The reciprocating compressor is divided into a compressor using a recipro method and a compressor using a linear method according to how the piston is driven.

In the compressor using the recipro method, a crank shaft is coupled with a rotary motor and the piston is coupled with the crank shaft, to thus change a rotating force of the rotary motor to a reciprocating motion.

In the compressor using the linear method, the piston connected with an actuator of a linear motor is linearly moved.

The reciprocating compressor using the linear method does not have such a crank shaft for changing the rotational motion into the linear motion, causing no frictional loss by the crank shaft, so it has high compression efficiency compared with a general compressor.

The reciprocating compressor can be employed for a refrigerator or an air-conditioner to control cooling capacity of the refrigerator or the air-conditioner by varying a compression ratio of the reciprocating compressor which can be varied by changing voltage inputted to the motor of the reciprocating compressor.

Thus, when the reciprocating compressor is employed for the refrigerator or the air-conditioner, the cooling capacity can be controlled by varying the compression ratio of the reciprocating compressor by varying a stroke voltage inputted to the reciprocating compressor. Herein, the stroke refers to a distance between a top dead center and a bottom dead center of the piston.

The reciprocating compressor according to the related art will now be described with reference to FIG. 1.

FIG. 1 is a schematic block diagram showing the construction of an apparatus for controlling an operation of the reciprocating compressor according to the related art.

As shown in FIG. 1, the related art apparatus for controlling an operation of the reciprocating compressor includes: a current detection unit 4 for detecting current applied to a motor (not shown) of a reciprocating compressor 6; a voltage detection unit 3 for detecting voltage applied to the motor; a stroke calculation unit 5 for calculating a stroke estimate value of the reciprocating compressor 6 based on the detected current and voltage values and a parameter of the motor; a comparing unit 1 for comparing the calculated stroke estimate value with a pre-set stroke reference value and outputting a difference value according to the comparison result; and a stroke control unit 2 for controlling an operation (stroke) of the compressor 6 by varying the voltage applied to the motor by controlling a turn-on period of a triac (not shown) connected in series to the motor according to the difference value.

The operation of the apparatus for controlling an operation of the reciprocating compressor will now be described with reference to FIG. 1.

First, the current detect unit 4 detects current applied to the motor (not shown) of the compressor 6 and outputs the detected current value to the stroke calculation unit 5.

At this time, the voltage detection unit 3 detects the voltage applied to the motor and outputs the detected voltage value to the stroke calculation unit 5.

The stroke calculation unit 5 calculates a stroke estimate value (X) of the compressor by substituting the detected current and voltage values and the parameter of the motor to equation (1) shown below and applies the calculated stroke estimate value (X) to the comparing unit 1:

$$X = \frac{1}{\alpha}\int (V_M - Ri - L\dot{i})dt \tag{1}$$

wherein 'R' is a motor resistance value, 'L' is a motor inductance value, $\alpha$ is a motor constant, $V_M$ is a voltage value applied to the motor, 'i' is a current value applied to the motor, and $\dot{i}$ is a time change rate of the current applied to the motor. Namely, $\dot{i}$ is a differential value (di/dt) of 'i'.

Thereafter, the comparing unit 1 compares the stroke estimate value and the stroke reference value and applies a difference value according to the comparison result to the stroke control unit 2.

The stroke control unit 2 controls stroke of the compressor 6 by varying the voltage applied to the motor of the compressor 6 based on the difference value.

This operation will now be described with reference to FIG. 2.

FIG. 2 is a flow chart illustrating the processes of a method for controlling an operation of the reciprocating compressor according to the related art.

First, when the stroke estimate value is applied to the comparing unit 1 by the stroke calculation unit 5 (S1), the comparing unit 1 compares the stroke estimate value and the pre-set stroke reference value (S2) and outputs the difference value according to the comparison result to the stroke control unit 2.

When the stroke estimate value is smaller than the stroke reference value, the stroke control unit 2 increases the voltage applied to the motor to control the stroke of the reciprocating compressor (S3), and when the stroke estimate value is greater than the stroke reference value, the stroke control unit 2 reduces the voltage applied to the motor (S4).

When the voltage applied to the motor is increased or reduced, the triac (not shown) electrically connected with the motor controls the turn-on period and applies the voltage to the motor.

The stroke reference value differs depending on a size of a load of the reciprocating compressor. Namely, when the load is large, the stroke reference value is increased not to reduce the stroke of the piston to thus prevent degradation of cooling capacity. Conversely, when the load is small, the stroke reference value is reduced not to increase the stroke of the piston and thus prevent an increase of the cooling capacity and generation of collision of the piston and the cylinder due to an excessive stroke (over-stroke).

The related art apparatus for controlling the operation of the reciprocating compressor estimates the stroke by using a motor parameter (α), resistance (R) and reactance (L), and controls the stroke by using the stroke estimate value.

However, in estimating the stroke, an error is generated due to the motor parameter and a component deviation, making it difficult to precisely control the stroke, which causes a problem that the piston of the reciprocating compressor cannot be precisely controlled to be positioned corresponding to a point TDC (Top Dead Center)=0, an optimum operation condition.

BRIEF DESCRIPTION OF THE INVENTION

Therefore, one object of the present invention is to provide an apparatus and method for controlling an operation of a reciprocating compressor whereby a point of inflection with respect to an operation frequency of the reciprocating compressor is detected at a point of time when a phase difference between current and stroke is uniformly maintained, and an operation of the reciprocating compressor is controlled upon recognizing the detected point of inflection with respect to the operation frequency as a point TDC=0.

Another object of the present invention is to provide an apparatus and method for controlling an operation of a reciprocating compressor whereby a point of inflection with respect to an operation frequency of the reciprocating compressor is detected at a point of time when a phase difference between current and speed is uniformly maintained, and an operation of the reciprocating compressor is controlled upon recognizing the detected point of inflection with respect to the operation frequency as a point TDC=0.

To achieve these and other advantages and in accordance with the purpose of the present invention, as embodied and broadly described herein, there is provided an apparatus for controlling an operation of a reciprocating compressor including: a control unit for detecting a phase difference between current and stroke and outputting a frequency inflection point detect signal or a frequency variable signal; and a stroke reference value control unit for determining whether a frequency inflection point has been detected or not according to the frequency inflection point detect signal and outputting a stroke reference value control signal based on the determining result.

To achieve the above object, there is also provided an apparatus for controlling an operation of a reciprocating compressor including: a control unit for detecting a phase difference between current and stroke and outputting a frequency inflection point detect signal or a frequency variable signal based on the detected phase difference; a stroke reference value control unit for determining whether a frequency inflection point has been detected or not according to the frequency inflection point detect signal and outputting a stroke reference value control signal based on the determining result; a stroke reference value determining unit for determining a stroke reference value based on the stroke reference value control signal; a PWM (Pulse Width Modulation) generating unit for generating a PWM signal based on a difference value between the stroke reference value and a current stroke or generating a PWM signal based on the frequency variable signal; and an inverter for varying voltage and frequency applied to a motor according to a PWM signal.

To achieve the above object, there is also provided a method for controlling an operation of a reciprocating compressor including: operating the reciprocating compressor with capacity corresponding to a certain stroke reference value; detecting voltage and current applied to a motor and calculating stroke by using the detected voltage and detected current; detecting a phase difference between the stroke and the current; and comparing the detected phase difference and a pre-set reference range and varying the stroke reference value based on the comparison result.

To achieve the above object, there is also provided a method for controlling an operation of a reciprocating compressor including: operating the reciprocating compressor with capacity corresponding to a certain stroke reference value; detecting voltage and current applied to a motor and calculating stroke by using the detected voltage and the detected current; calculating speed of the reciprocating compressor by using the calculated stroke and detecting a phase difference between the calculated speed and the current; and comparing the detected phase difference and a pre-set reference range and varying the stroke reference value based on the comparison result.

The foregoing and other objects, features, aspects and advantages of the present invention will become more apparent from the following detailed description of the present invention when taken in conjunction with the accompanying drawings.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE INVENTION

Figure 1:
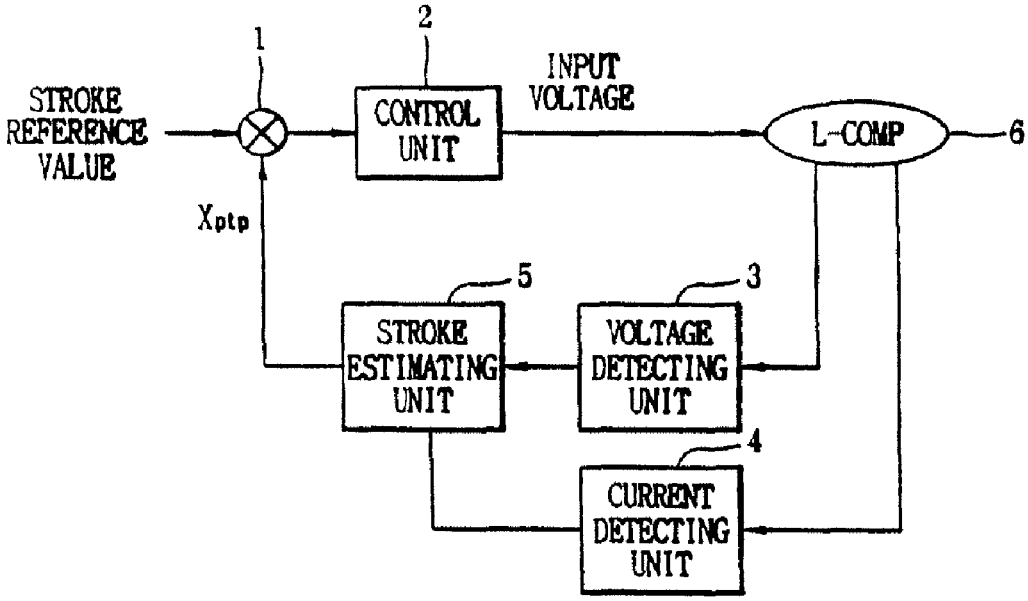
FIG. 1 RELATED ART
FIG. 1 is a schematic block diagram showing an apparatus for controlling an operation of a reciprocating compressor according to the related art.
Figure 2:
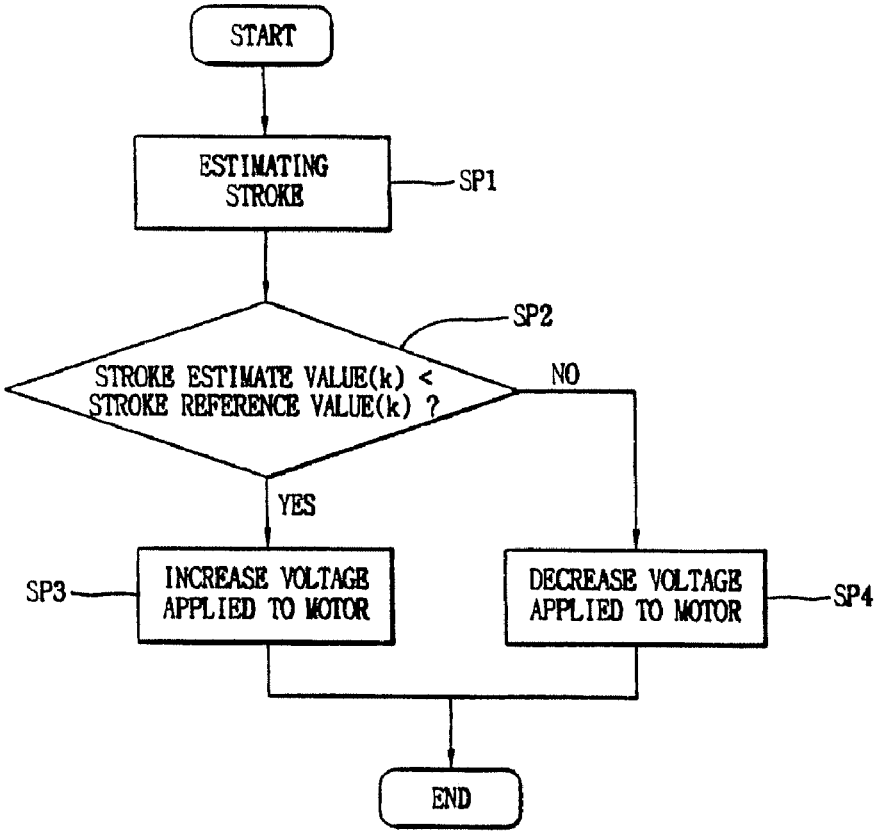
FIG. 2 RELATED ART
FIG. 2 is a flow chart illustrating the processes of a method for controlling an operation of the reciprocating compressor according to the related art.
Figure 3:
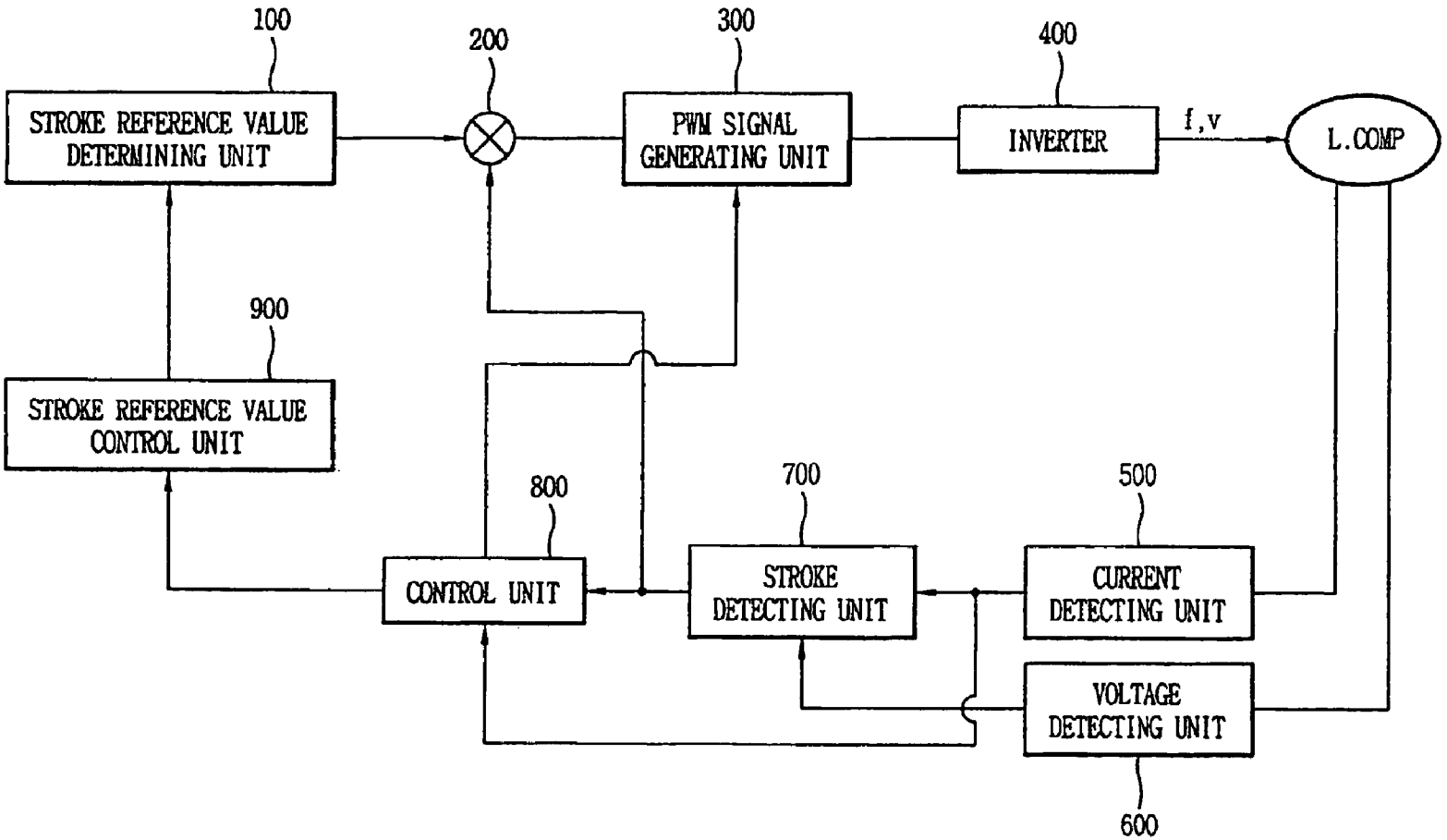
FIG. 3 is a schematic block diagram showing the construction of an apparatus for controlling an operation of a reciprocating compressor according to the present invention.
Figure 4:
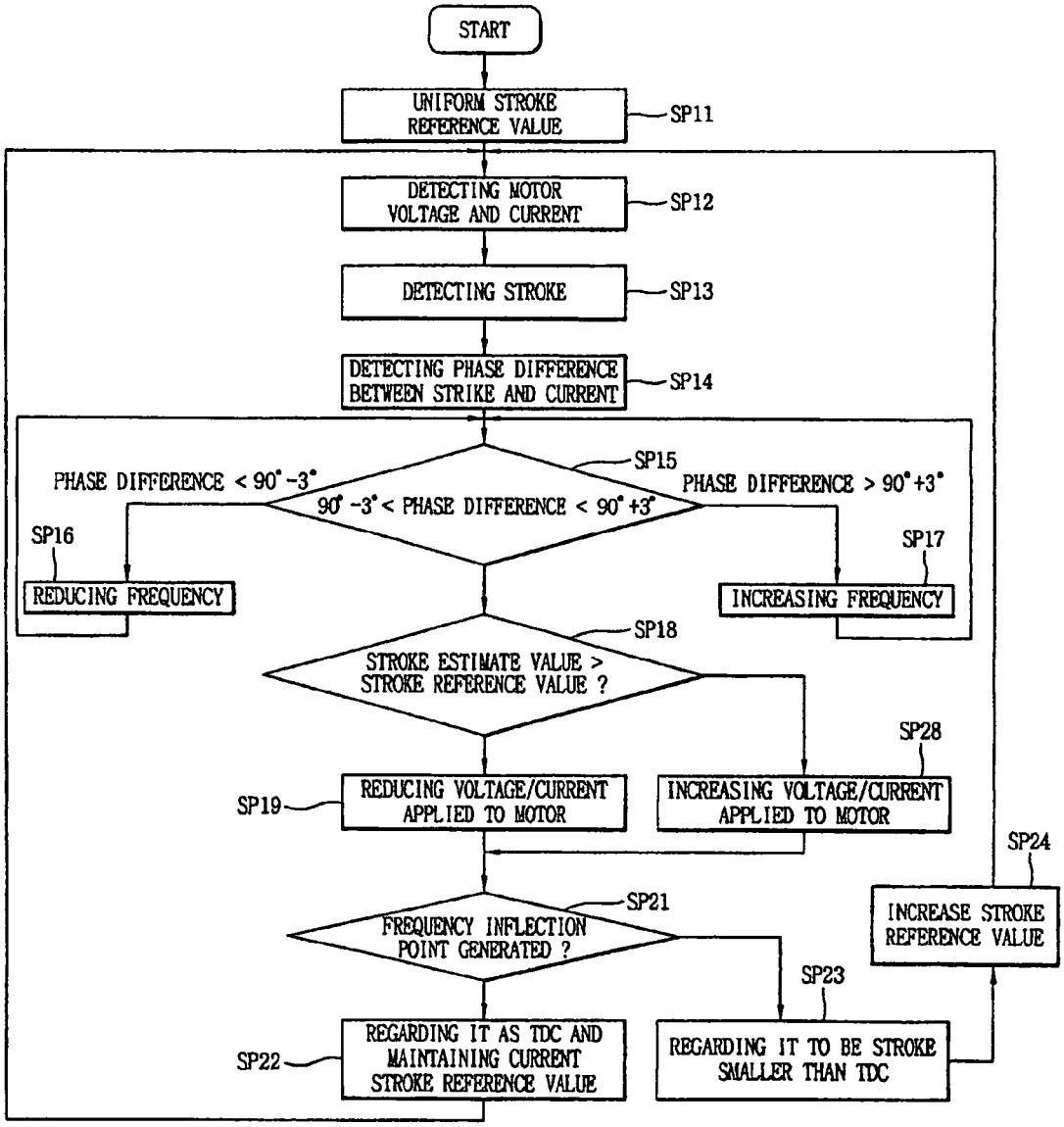
FIG. 4 is a flow chart illustrating the processes of a method for controlling an operation of the reciprocating compressor according to the present invention.

An apparatus and method for controlling an operation of a reciprocating compressor by which an inflection point with respect to an operation frequency of a reciprocating compressor is detected at a point of time when a phase difference between current and stroke is uniformly maintained, and the detected inflection point with respect to the operation frequency is recognized as a point TDC=0 to thus control an operation of a reciprocating compressor, according to the exemplary embodiment of the present invention will now be described with reference to FIGS. 3 and 4.

The present invention is based upon such recognition that an inflection point of an operation frequency at a point of time when a phase difference between current and stroke or a phase difference between speed and stroke becomes uniform is identical to a point where TDC=0, where an optimum operation efficiency is obtained.

Herein, the TDC physically refers to a position of a piston when a compression stroke of the piston is completed.

In this case, when the piston is positioned at TDC=0, efficiency of the reciprocating compressor is maximized, so in controlling the operation of the reciprocating compressor, the piston is controlled to come to the position where TDC is 0.

FIG. 3 is a schematic block diagram showing the construction of an apparatus for controlling an operation of a reciprocating compressor according to the present invention.

As shown in FIG. 3, the apparatus for controlling the operation of the reciprocating compressor includes a stroke reference value determining unit 100, a comparator 200, a PWM (Pulse Width Modulation) signal generating unit 300, an inverter 400, a current detecting unit 500, a voltage detecting unit 600, a stroke detecting unit 700, a control unit 800 and a stroke reference value control unit 900.

The current detecting unit 500 detects current of a motor of the reciprocating compressor, and the voltage detecting unit 600 detects voltage of the motor of the reciprocating compressor.

The stroke detecting unit 700 calculates stroke by using the detected current and detected voltage.

The control unit 800 detects a phase difference between the detected current and the stroke, and outputs a frequency variable signal or a frequency inflection point detect signal based on the detected phase difference.

Namely, when the detected phase difference is within a pre-set reference range, the control unit 800 outputs the frequency inflection point detect signal, and if the detected phase difference is not within the pre-set reference range, the control unit 800 outputs the frequency variable signal.

In a different embodiment, the control unit 800 may calculate speed by using stroke which has been detected by the stroke detecting unit 700, obtain a phase difference between the calculated speed and the current, compare the detected phase difference with a pre-set reference phase difference, and output a frequency variable signal or a frequency inflection point detect signal according to the comparison.

Namely, when the detected phase difference is within the reference range, the control unit 800 outputs the frequency inflection point detect signal, whereas if the detected phase difference is not within the reference range, the control unit 800 outputs the frequency variable signal.

The PWM signal generating unit 300 generates a PWM signal for varying frequency of voltage applied to the motor based on the frequency variable signal, and the inverter 400 varies the voltage and frequency applied to the motor of the reciprocating compressor according to the PWM signal.

The PWM signal generating unit 300 analyzes the frequency variable signal, and if the phase difference is greater than the pre-set reference range, the PWM signal generating unit 300 generates a PWM signal for increasing the frequency.

If, however, the phase difference is smaller than the pre-set reference range, the PWM signal generating unit 300 generates a PWM signal for reducing the frequency.

The stroke command reference control unit 900 determines whether a frequency inflection point has been detected or not in the frequency inflection point detect signal, and outputs a stroke reference value control signal based on the determining result.

Namely, when a frequency inflection point is detected by the frequency inflection point detect signal, the stroke reference value control unit 900 outputs a control signal for maintaining a current stroke reference value, and if no frequency inflection point is detected, the stroke reference value control unit 900 outputs a control signal for increasing the current stroke reference value.

The stroke reference value determining unit 100 determines the stroke reference value based on the stroke reference value control signal.

The operation of the present invention will now be described with reference to FIG. 4.

First, it is assumed that the reciprocating compressor is operated with a certain stroke reference value (SP11).

In this state, the current detecting unit 500 detects current of the motor of the reciprocating compressor, and the voltage detecting unit 600 detects voltage of the motor of the reciprocating compressor (SP12).

Thereafter, the stroke detecting unit 700 calculates stroke by using the detected current and the detected voltage (SP13).

And then, the control unit 800 detects a phase difference between the detected current and stroke (SP14), and outputs a frequency variable signal or a frequency inflection point detect signal based on the detected phase difference.

Herein, in a different embodiment, the control unit 800 can calculate speed by using the stroke, detect a phase difference between the speed and the current, and output a frequency variable signal or a frequency inflection point detect signal based on the detected phase difference.

Thereafter, the control unit 800 compares the phase difference between the stroke (speed) and the current with a pre-set reference range (a value within the range of about 87° to 93°), and if the detected phase difference is within the reference range, the control unit 800 outputs the frequency inflection point detect signal.

Namely, the current stroke estimate value and the stroke reference value are compared (SP18), and the voltage applied to the motor of the reciprocating compressor is varied based on the comparison result (SP19 and SP20).

And then, the control unit 800 determines whether there occurs an inflection point of the frequency.

When a frequency inflection point occurs (SP21), the control unit 800 determines this as being a point where the current stroke is TDC=0, and the current stroke reference value is maintained as it is (SP22).

If no frequency inflection point occurs, the control unit 800 regards the current stroke as a stroke smaller than TDC=0 (SP23) and increases the stroke reference value (SP24).

And then, the comparator 200 obtains a difference value between the stroke reference value and the stroke, and the PWM signal generating unit 300 generates a PWM signal corresponding to the difference value and applies it to the inverter 400.

Accordingly, the inverter 400 varies the frequency and voltage according to the PWM signal and applies the varied frequency and voltage to the motor of the reciprocating compressor.

Meanwhile, if the phase difference between the stroke and the current is not a value within the pre-set reference range, the control unit 800 controls the frequency to be increased or decreased.

Namely, if the phase difference is greater than the reference range, the control unit 800 increases a duty rate of the PWM signal to thus increase the frequency (SP17), and if the phase difference is smaller than the reference range, the control unit 800 reduces the duty rate of the PWM signal to thus reduce the frequency (SP16).

That is, in the present invention, the frequency is variably controlled to make the phase difference between the current and the stroke uniform, the frequency inflection point is detected at a point of time when the phase difference between the current and the stroke is uniformly maintained, and the frequency inflection point is recognized a point where the TDC=0 to control the operation of the reciprocating compressor.

As so far described, the apparatus and method for controlling the operation of the reciprocating compressor have many advantages. That is, for example, because the frequency is variably controlled to make the phase difference between the current and the stroke uniform, the frequency inflection point is detected at a point of time when the phase difference between the current and the stroke is uniformly maintained, and the frequency inflection point is recognized the point where the TDC=0 to control the operation of the reciprocating compressor, power consumption can be reduced and reliability of controlling can be improved.

In addition, because the frequency is variably controlled to make the phase difference between the speed and the stroke uniform, the frequency inflection point is detected at a point of time when the phase difference between the speed and the stroke is uniformly maintained, and the frequency inflection point is recognized the point where the TDC=0 to control the operation of the reciprocating compressor, power consumption can be reduced and reliability of controlling can be improved.

As the present invention may be embodied in several forms without departing from the spirit or essential characteristics thereof, it should also be understood that the above-described embodiments are not limited by any of the details of the foregoing description, unless otherwise specified, but rather should be construed broadly within its spirit and scope as defined in the appended claims, and therefore all changes and modifications that fall within the metes and bounds of the claims, or equivalents of such metes and bounds are therefore intended to be embraced by the appended claims.

What is claimed is:

1. An apparatus of controlling an operation of a reciprocating compressor comprising:

a first control unit for detecting a phase difference between current and stroke and outputting a frequency inflection point detect signal or a frequency variable signal;

a stroke reference value control unit for determining whether a frequency inflection point has been detected or not according to the frequency inflection point detect signal and outputting a stroke reference value control signal based on the determining result;

a PWM (Pulse Width Modulation) signal generating unit for generating a PWM signal based on a difference value between a stroke reference value and a current stroke reference value, or generating a PWM signal based on the frequency variable signal; and an inverter for varying voltage and frequency applied to a motor according to the PWM signal, wherein the PWM signal generating unit analyzes the frequency variable signal, and if the phase difference is greater than a pre-set reference range, the PWM signal generating unit generates the PWM signal for increasing the frequency.

2. The apparatus of claim 1, further comprising:

a stroke reference value determining unit for determining the stroke reference value based on the stroke reference value control signal.

3. The apparatus of claim 1, wherein when the detected phase difference is within the pre-set reference range, the first control unit outputs the frequency inflection point detect signal.

4. The apparatus of claim 1, wherein if the detected phase difference is not a value within the pre-set reference range, the first control unit outputs the frequency variable signal.

5. The apparatus of claim 1, wherein when the frequency inflection point is detected by the frequency inflection point detect signal, the stroke reference value control unit outputs the stroke reference value control signal for maintaining the current stroke reference value, and if no frequency inflection point is detected, the stroke reference value control unit outputs the stroke reference value control signal for increasing the current stroke reference value.

6. The apparatus of claim 1, wherein the PWM signal generating unit analyzes the frequency variable signal, and if the phase difference is smaller than the pre-set reference range, the PWM signal generating unit generates the PWM signal for reducing the frequency.

7. The apparatus of claim 1, wherein the first control unit calculates speed with the stroke, detects a phase difference between the speed and the current, compares the phase difference between the speed and the current with another pre-set reference range, and outputs the frequency variable signal or the frequency inflection point detect signal according to the comparison result.

8. An apparatus for controlling an operation of a reciprocating compressor comprising:

a first control unit for detecting a phase difference between current and stroke and outputting a frequency inflection point detect signal or a frequency variable signal based on the detected phase difference;

a stroke reference value control unit for determining whether a frequency inflection point has been detected or not according to the frequency inflection point detect signal and outputting a stroke reference value control signal based on the determining result;

a stroke reference value determining unit for determining a stroke reference value based on the stroke reference value control signal;

a PWM (Pulse Width Modulation) signal generating unit for generating a PWM signal based on a difference value between the stroke reference value and a current stroke reference value or generating a PWM signal based on the frequency variable signal; and an inverter for varying voltage and frequency applied to a motor according to the PWM signal, wherein the PWM signal generating unit analyzes the frequency variable signal, and if the phase difference is greater than a pre-set reference range, the PWM signal generating unit generates the PWM signal for increasing the frequency, and if the phase difference has a value smaller than the pre-set reference range, the PWM signal generating unit generates the PWM signal for reducing the frequency.

9. The apparatus of claim 8, wherein if the phase difference is within the pre-set reference range, the first control unit outputs the frequency inflection point detect signal.

10. The apparatus of claim 8, wherein if the phase difference is not a value within the pre-set reference range, the first control unit outputs the frequency variable signal.

11. The apparatus of claim 8, wherein when the frequency inflection point is detected by the frequency inflection point detect signal, the stroke reference value control unit outputs the stroke reference value control signal for maintaining the current stroke reference value, and if no frequency inflection point is detected, the stroke reference value control unit outputs the stroke reference value control signal for increasing the current stroke reference value.

12. The apparatus of claim 8, wherein the first control unit calculates speed with the stroke, detects a phase difference between the speed and the current, compares the phase difference between the speed and the current with another pre-set reference range, and outputs the frequency variable signal or the frequency inflection point detect signal according to the comparison result.

13. A method for controlling an operation of a reciprocating compressor comprising:

operating the reciprocating compressor with capacity corresponding to a stroke reference value;

detecting voltage and current applied to a motor and calculating stroke by using the detected voltage and detected current;

detecting a phase difference between the stroke and the current;

comparing the detected phase difference and a pre-set reference range and varying the stroke reference value based on the comparison result;

generating a PWM (Pulse Width Modulation) signal based on a difference value between the stroke reference value and a current stroke reference value, or generating a PWM signal based on a frequency variable signal; and varying voltage and frequency applied to the motor according to the PWM signal, wherein the step of generating the PWM signal comprises:

analyzing the frequency variable signal and generating the PWM signal for increasing the frequency if the phase difference is greater than the pre-set reference range.

14. The method of claim 13, wherein the step of varying the stroke reference value comprises:

increasing the frequency if the phase difference has a value greater than the pre-set reference range.

15. The method of claim 13, wherein the step of varying the stroke reference value comprises:

reducing the frequency if the phase difference is smaller than the pre-set reference range.

16. The method of claim 13, wherein the step of varying the stroke reference value comprises:

detecting a frequency inflection point if the phase difference is within the pre-set reference range; and maintaining the current stroke reference value when the frequency inflection point is detected, and increasing the stroke reference value if no frequency inflection point is detected.

17. A method for controlling an operation of a reciprocating compressor comprising:

operating the reciprocating compressor with capacity corresponding to a stroke reference value;

detecting voltage and current applied to a motor and calculating stroke by using the detected voltage and the detected current;

calculating speed of the reciprocating compressor by using the calculated stroke and detecting a phase difference between the calculated speed and the current;

comparing the detected phase difference and a pre-set reference range and varying the stroke reference value based on the comparison result;

generating a PWM (Pulse Width Modulation) signal based on a difference value between the stroke reference value and a current stroke reference value, or generating a PWM signal based on a frequency variable signal; and varying voltage and frequency applied to the motor according to the PWM signal, wherein the step of generating the PWM signal comprises:

analyzing the frequency variable signal and generating the PWM signal for increasing the frequency if the phase difference is greater than a pre-set reference range.

18. The method of claim 17, wherein the step of varying the stroke reference value comprises:

increasing the frequency if the phase difference has a value greater than the pre-set reference range.

19. The method of claim 17, wherein the step of varying the stroke reference value comprises:

reducing the frequency if the phase difference has a value smaller than the pre-set reference range.

20. The method of claim 17, wherein the step of varying the stroke reference value comprises:

detecting a frequency inflection point if the phase difference is within the pre-set reference range; and maintaining the current stroke reference value when the frequency inflection point is detected, and increasing the stroke reference value if no frequency inflection point is detected.

* * * * *